United States Patent [19]

Tenner

[11] 4,383,155

[45] May 10, 1983

[54] PIVOTED-ACTUATOR SWITCH WITH PC BOARD SWITCHED LIGHT INDICATOR

[75] Inventor: Richard B. Tenner, Milwaukee, Wis.

[73] Assignee: Eaton Corporation, Cleveland, Ohio

[21] Appl. No.: 275,548

[22] Filed: Jun. 18, 1981

[51] Int. Cl.[3] ..... H01H 9/16

[52] U.S. Cl. ..... 200/315; 200/339; 200/292

[58] Field of Search ..... 200/310–317, 200/292

[56] References Cited

U.S. PATENT DOCUMENTS

| | | | |
|---|---|---|---|
| 3,321,600 | 5/1967 | Bernutz | 200/292 |
| 3,544,749 | 12/1970 | DeAngelo | 200/315 |
| 3,711,669 | 1/1973 | Keranen | 200/315 |
| 3,735,077 | 5/1973 | Ohashi | 200/315 |
| 3,761,664 | 9/1973 | Kodaira | 200/315 X |
| 4,016,561 | 9/1977 | Parker et al. | 200/314 X |
| 4,082,934 | 4/1978 | Piber | 200/315 |
| 4,097,704 | 6/1978 | Piber | 200/157 |
| 4,115,673 | 9/1978 | Smith | 200/315 |
| 4,121,071 | 10/1978 | Campbell et al. | 200/315 X |
| 4,172,973 | 10/1979 | Sano | 200/315 |
| 4,182,944 | 1/1980 | Sano | 200/315 |

FOREIGN PATENT DOCUMENTS

| | | | |
|---|---|---|---|
| 1082815 | 7/1959 | Fed. Rep. of Germany | 200/339 |
| 624508 | 6/1949 | United Kingdom | 200/315 |

*Primary Examiner*—John W. Shepperd
*Assistant Examiner*—Ernest G. Cusick
*Attorney, Agent, or Firm*—C. H. Grace; Larry G. Vande Zande

[57] ABSTRACT

A pivoted-actuator switch having two subassemblies snap-in mounted together. An operator subassembly includes an operating member which may be a toggle lever (24) or a rocker button (32), and LED indicator lamp (22, 34) mounted in a hole in the operating member, a double-sided PC board inserted into notches (24*d*, 24*e*) or a notch (32*b*) in the opening member and connected to the leads (22*a*, 34*a*) of the LED, and an actuator (16) snap-in mounted to the operating member to retain the PC board therein with its lower portion extending down through the actuator. A housing subassembly includes an insulating base 2 supporting sets of stationary switch contact-terminals (4, 6) and LED contact-terminals (8, 10), and movable contacts (12) therein, switch mounting clips (40) on opposite ends of the base for snap-in mounting the switch in a hole in a mounting panel, and a bezel (42) snap-in secured to the upper rim of the base. The operator subassembly is snap-in mounted to the housing subassembly by snapping two trunnions (16*a*, 16*b*) on the actuator into pivot holes (2*b*) in opposite side walls of the base to pivotally mount the operator in the housing.

9 Claims, 10 Drawing Figures

Fig. 8
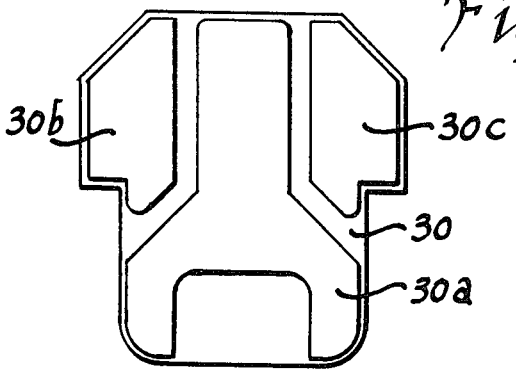
Fig. 9
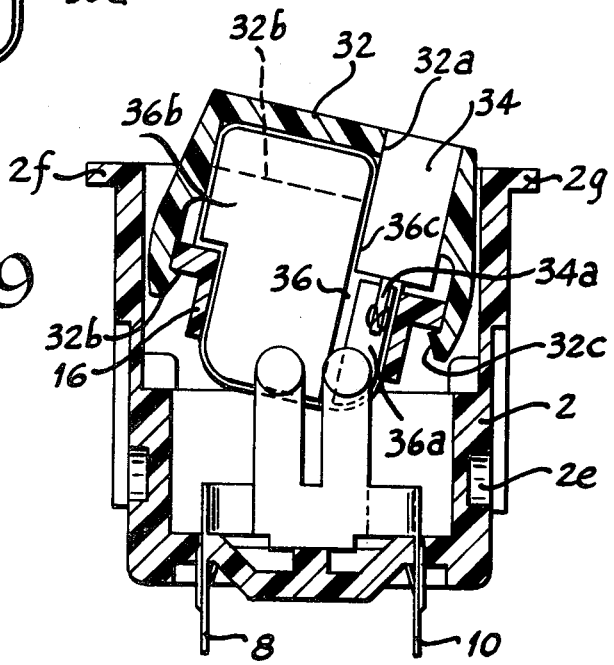
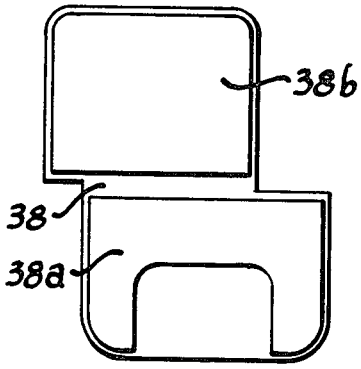
Fig. 10

PIVOTED-ACTUATOR SWITCH WITH PC BOARD SWITCHED LIGHT INDICATOR

BACKGROUND OF THE INVENTION

Switches using printed circuit boards as contacts have been known heretofore. For example, J. Bernutz U.S. Pat. No. 3,321,600, dated May 23, 1967, shows a switch having a spring strip body equipped with contact springs therewithin and a switching slide carrying printed leads slidably received therewithin to variably contact the contact springs. Also, E. T. Piber U.S. Pat. No. 4,097,704, dated June 27, 1978, shows a trigger switch having a reversing switch superstructure at its upper portion. This reversing switch has a plurality of contact-terminals mounted on an insulating board and a slidable PC board for selectively bridging the contact-terminals.

While these prior switches have been useful for their intended purposes, this invention relates to improvements thereover.

SUMMARY OF THE INVENTION

An object of the invention is to provide an improved pivoted-actuator switch.

A more specific object of the invention is to provide a pivoted-actuator switch with improved switched light indicator means.

Another specific object of the invention is to provide a switch with an improved pivoted actuator mounting interchangeable printed circuit contact means to obtain variable operation of an indicator lamp mounted on its operating member.

Another specific object of the invention is to provide a pivoted-actuator switch having conventional switch contacts with improved indicator lamp contacts comprising a printed circuit board removably mounted on the actuator.

Another specific object of the invention is to provide an improved pivoted-actuator switch having an actuator subassembly snap-in mounted to a base subassembly, the base subassembly mounting stationary and movable switch contacts and stationary indicator lamp contacts, and the actuator subassembly mounting an interchangeable printed circuit board constituting movable indicator lamp contacts and a removable operating member retaining the printed circuit board in place and mounting an indicator lamp.

Other objects and advantages of the invention will hereinafter appear.

BRIEF DESCRIPTION OF THE DRAWINGS

FIG. 8 is an enlarged elevational view of an alternative ON-OFF-ON indicator lamp PC board contact structure for the switch of FIGS. 1–6;

FIG. 9 is an enlarged center cross-sectional view of a rocker button modification of the OFF-ON switch showing the alternative indicator lamp PC board and connection of the indicator lamp thereto;

FIG. 10 is an enlarged elevational view of an alternative ON-OFF-ON indicator lamp PC board contact structure for the rocker switch of FIG. 9.

DESCRIPTION OF THE PREFERRED EMBODIMENT

Figure 1:
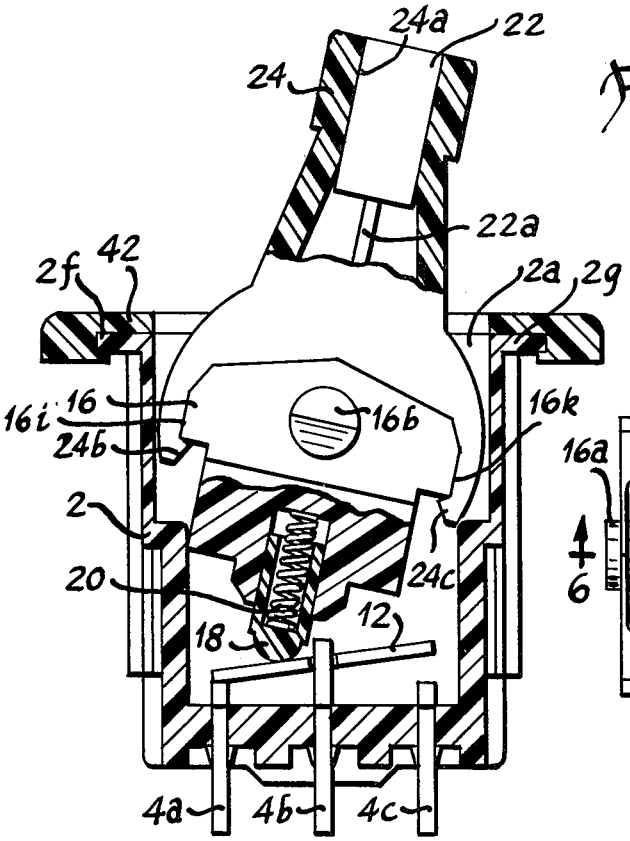
FIG. 1 is an enlarged partial cross-sectional view of a pivoted actuator toggle switch taken substantially along line 1—1 of FIG. 3 to show 1 pole of the 2 pole OFF-ON switch, contacts, the actuator, operating lever and indicator lamp.
Figure 2:
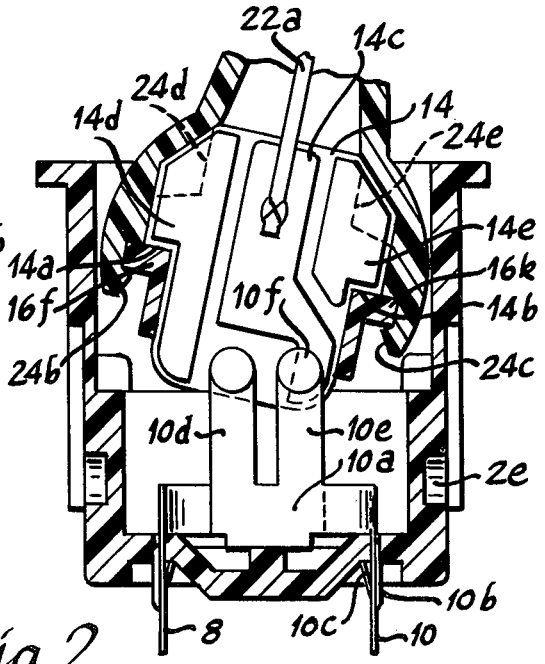
FIG. 2 is a center cross-sectional view of the switch of FIG. 1 taken substantially along line 2—2 of FIG. 3 to show the indicator lamp contact terminals and associated PC (printed circuit) board movable contacts.
Figure 3:
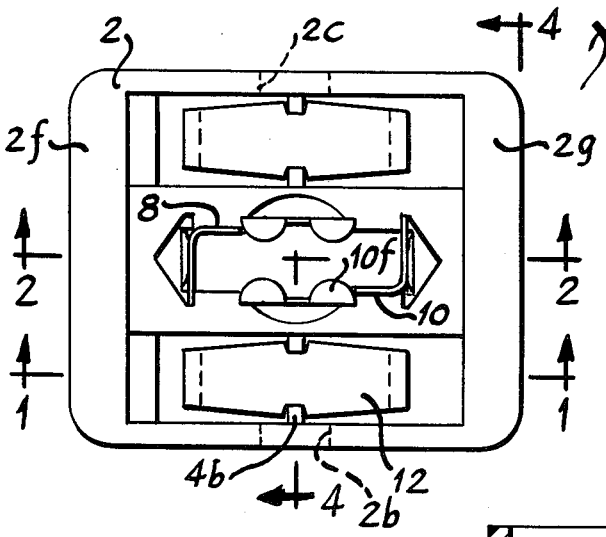
FIG. 3 is the top view of the base of the switch of FIGS. 1 and 2, with the actuator subassembly removed, showing the switch contacts and the indicator lamp contact terminals in the middle.
Figure 4:
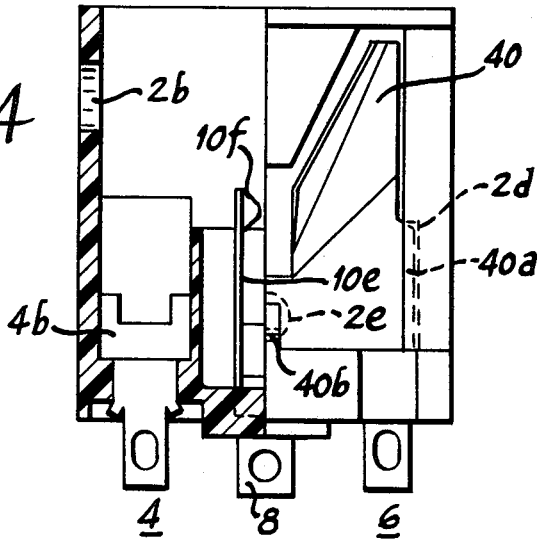
FIG. 4 is a half cross-sectional view of the switch base of FIG. 3 taken substantially along line 4—4 thereof with the movable switch contact removed to show one of the center stationary switch contact-terminals and a side view of one of the indicator lamp contact-terminals.

Referring to FIGS. 1–6 there is shown a pivoted actuator switch with PC board switched light indicator constructed in accordance with the invention. As shown therein, the switch is a 2-pole double-throw version comprising an insulating molded base 2 mounting two sets 4 and 6 of switch contact-terminals as shown in FIG. 4 and a pair of lamp contact-terminals 8 and 10 as shown in FIG. 2. Each such set of switch contact-terminals has three contact-terminals. As shown in FIG. 1 with respect to set 4, this set has three contact-terminals *4a*, *4b* and *4c* spaced apart, center terminal *4b* supporting a rockable, movable contact capable of engaging either end contact *4a* or the other end contact *4c* depending on the direction of rocking thereof. As shown in FIG. 3, center contact-terminal *4b* has a cut-out at its upper end forming a "U" shaped section and movable contact 12 has a pair of notches on opposite sides of the center for seating in said "U" shaped upper portion of the contact-terminal and rocking thereon and retaining this movable contact in in position relative to the other two stationary contact-terminals *4a* and *4c*. These contact-terminals preferably have an enlarged upper contact portion so that when they are inserted through holes in the bottom of the base and staked at their opposite edges below the bottom of the base, they are held securely mounted to the bottom of the base.

As shown in FIGS. 2, 3, and 4, lamp contact terminals 8 and 10 are mounted in the bottom of the base so that their pairs of contact fingers engage opposite surfaces of printed circuit (PC) board 14. Each lamp contact terminal such as 10 has a main portion *10a* lying along the bottom of the base, a leg portion *10b* having a sheared tongue *10c* that snaps below the bottom of the base when the leg portion is inserted through the hole in the base thereby to secure the contact-terminal rigidly to the base and a pair of upstanding contact fingers *10d* and *10e* for engaging the printed circuit on the PC board. Each contact finger *10d* and *10e* has its upper end formed into a convex portion such as *10f* shown in FIG. 4 for engaging, being biased against and sliding along the printed circuit on the printed circuit board as the operating lever is actuated. Leg portion 10*b* of this contact terminal is bent rearwardly at a right angle from the main portion thereof. Contact-terminal 8 is identical to contact terminal 10 except that it is turned 180 degrees such that its contact fingers are behind the contact fingers of contact terminal 10 and spaced therefrom so that they are not visible in FIG. 2, such spacing being arranged so that their convex portions engage and are biased against the opposite side of the circuit board.

Figure 5:
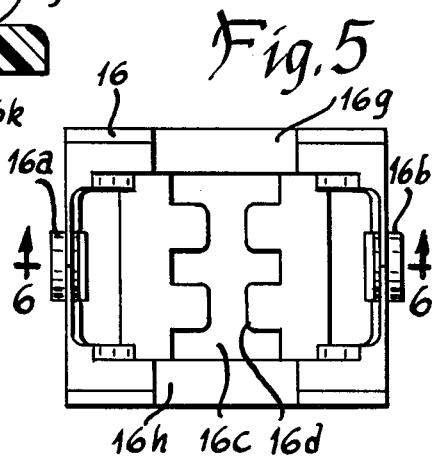
FIG. 5 is a top view of the actuator of the switch of FIGS. 1–4 showing the trunnions for pivotally supporting the same in the base and also showing the slot for mounting the printed circuit board.
Figure 6:
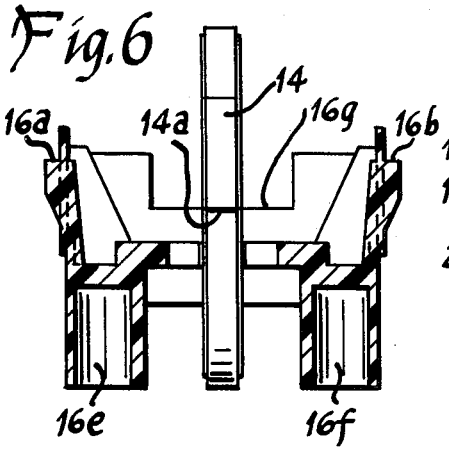
FIG. 6 is a cross-sectional view of the actuator taken substantially along line 6—6 of FIG. 5 and additionally showing the printed circuit board mounted in the slot thereof.

Actuator 16 is provided with means for pivotally mounting the same in base 2. For this purpose, actuator 16 is provided with a pair of trunnions 16*a* and 16*b* as shown in FIG. 5 that snap into holes 2*b* and 2*c* (FIGS. 3 and 4) in the opposite sides of the base when the actuator is inserted into compartment 2*a* within the base. As shown in FIGS. 1 and 6, the lower halves of these trunnions are beveled to facilitate insertion of the actuator between the side walls of the base which are resilient and spread apart to receive the actuator. As shown in FIG. 5, actuator 16 is provided with a hole 16*c* down through its center for receiving printed circuit board 14. As shown in FIG. 5, this hole has pairs of projections or teeth 16*d* on opposite sides thereof for abutting against the opposite surfaces of the printed circuit board and holding the same centered therein as shown in FIG. 6. Actuator 16 is also provided with a pair of blind holes 16*e* and 16*f* as shown in FIG. 6 for receiving and retaining therein a pair of plungers and their bias springs such as 18 and 20, respectively, shown in FIG. 1, these plungers being for the purpose of sliding along and actuating the movable contacts such as contact 12 in FIG. 1. Actuator 16 has a pair of "U" shaped notches 16*g* and 16*h* on opposite sides thereof supporting printed circuit board 14. For this purpose, printed circuit board 14 has a wider upper portion as shown in FIG. 2 to provide a pair of shoulders 14*a* and 14*b* that rest on the bottom edges of notches 16*g* and 16*h* of the actuator as shown in FIG. 2.

The switch is also provided with operating means which serves also as means for supporting an LED (light emitting diode) indicator lamp 22. This means comprises a snap in operating lever 24. This operating lever 24 is in the form of a toggle lever having a hole 24*a* at its upper portion which snugly receives and supports indicator lamp 22 so that the light can be seen at the end of the handle. A pair of connector leads 22*a* extend down from lamp 22 through the hole in the handle as shown in FIG. 1 and are electrically connected as by soldering to the printed circuits on opposite sides of printed circuit board 14 as shown in FIG. 2. For snap-in retention of the toggle lever on the actuator, the toggle lever is provided with a pair of wide hooks 24*b* and 24*c* that snap down below lateral flanges 16*j* and 16*k* on the upper portion of the actuator. Toggle lever 24 also has a pair of channels therewithin formed by two pairs of spaced walls 24*d* and 24*e* as shown by broken lines in FIG. 2 that receive the left and right upper portions of the printed circuit board to retain the same centered therewithin.

It will be apparent from the foregoing that the switch may be assembled by press fitting the indicator lamp within the hole in the toggle lever handle and then inserting the printed circuit board up into the toggle lever channels and soldering the leads to the printed circuit on opposite sides thereof. The toggle lever subassembly may then be snap-mounted onto the actuator and the actuator snap-in mounted into the base. Or, on the other hand, the actuator may be first snap-in mounted to the base and then this subassembly of the toggle lever, lamp and printed circuit board may be snap-in mounted onto the actuator making sure that the lower portion of the circuit board enters between the pairs of upstanding fingers of the lamp contact-terminals.

The structure of this switch adapts it to a variety of operating lever configurations and contact functions. FIGS. 1–6 show a toggle lever switch of the off-on type. For this OFF-ON function printed circuit board 14 is provided with a pair of like printed circuits 14*c* as shown in FIG. 2 on opposite sides of the printed circuit board directly opposite one another. On this PC board printed circuit segments 14*d* and 14*e* are optional as they presently serve no purpose. With this arrangement, the switch will be "on" in the position shown in FIGS. 1 and 2 and the lamp will be connected through printed circuit 14*c* and the corresponding printed circuit on the other side of the board to contact-terminals 8 and 10. Therefore, if the toggle lever is pivoted counterclockwise toward the left, the switch will be actuated to its "off" position and the lamp will be disconnected from lamp contact-terminals 8 and 10.

Figure 7:
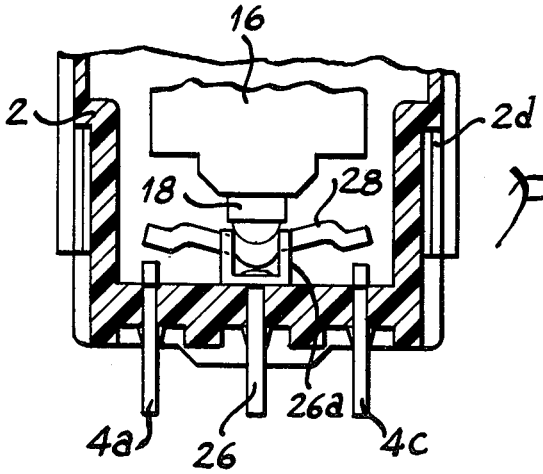
FIG. 7 is a fragmentary cross-sectional view through one pole of the switch showing an alternative ON-OFF-ON contact structure.

FIGS. 7 and 8 show a modification of the switch of FIGS. 1–6. As will be apparent, this modification is an ON-OFF-ON version of switch. This modification requires a different central switch contact-terminal 26 as shown in FIG. 7 and a different movable contact 28. This modification also requires a different printed circuit 30*a* mounted on PC board 30 as shown in FIG. 8. Contact-terminal 26 has a cradle 26*a* on its upper end for supporting movable contact 28, the function of this cradle being to support movable contact 28 in its "off" position as well as in either "on" position. For indication of the two "on" positions of this modification, printed circuit board 30 in FIG. 8 has a printed circuit segment 30*a* in the form of an inverted Y on each side of the board so that when the switch is in either "on" position, the lamp will be connected to the lamp terminals. Segments 30*b* and 30*c* in FIG. 8 are optional and serve no useful purpose in this modification.

FIGS. 9 and 10 show further modifications of the switch. One difference in these modifications is that the switch uses a rocker button 32 rather than a toggle lever, however, this version is also adaptable to either OFF-ON operation or ON-OFF-ON operation. For this purpose, rocker button 32 is provided with a lamp mounting hole 32*a* at one side thereof and LED lamp 34 is securely retained therein. Also printed circuit board 36 is provided with a notch 36*c* at one side to provide space for lamp 34. This board also has a pair of printed circuit segments 36*a*, these being like segments and one being on each side of the board so as to connect the two lamp leads which are soldered thereto to contact-terminals 8 and 10 when the rocker button is in the "on" position as shown in FIG. 9. Printed circuit segments 36*b* are optical as they are not used for any function at this time.

If printed circuit board 38 shown in FIG. 10 were substituted for that in FIG. 9, the switch would be provided with ON-OFF-ON operation. This is due to the shape of printed circuit segment 38*a* on opposite sides of the PC board. As will be apparent, these printed circuit segments 38*a* would be engaged by the lamp contact terminal fingers in either "on" position of the rocker button and would be completely disengaged by those contact fingers in the center "off" position of the rocker button.

As shown in FIG. 4, a mounting clip or retainer 40 is snap-in assembled at each of the two opposite end walls of the base on all versions of the switch. This retainer is assembled by squeezing the same to allow its angularly-formed side flaps 40*a* to snap into undercut grooves 2*d*, shown in FIGS. 4 and 7, at the sides of the end wall of the base. These side flaps 40*a* have a substantially 45 degree inward angle to afford entry thereof into their grooves. At the same time, a sheared and formed inward projection 40*b* at the central lower portion of this retainer enters a blind hole 2*e* at the end of the base. The side flaps prevent the retainer from sliding upwardly and the projection prevents it from sliding downwardly on the base. These retainers 40 snap-in mount the switch in a rectangular hole in a mounting panel.

A bezel 42 shown in FIG. 1 may be snap-in assembled to flanges 2*f* and 2*g* at the upper ends of the base.

It will be apparent from the foregoing that variations in the switch may be made in both the operating lever and the contact operation with a minimum substitution of parts.

While the apparatus hereinbefore described is effectively adapted to fulfill the object stated, it is to be understood that the invention is not intended to be confined to the particular preferred embodiment of pivoted-actuator switch with PC board switched light indicator disclosed, inasmuch as it is susceptible of various modifications without departing from the scope of the appended claims.

I claim:

1. A pivoted-actuator switch with PC board switched light indicator comprising two subassemblies including:

an actuator subassembly comprising:

an operating member having a hole extending through an upper surface thereof to a bottom side of said operating member;

an indicator lamp mounted in said hole so as to be visible at the upper surface of said operating member and having electric leads extending through said hole to the bottom side of said operating member;

a PC board positioned partly within said operating member for movement therewith and having printed circuits on opposite surfaces thereof connected to said leads;

and a switch contact actuator snap-in mounted to said operating member and having an aperture through which said PC board partly extends;

and a housing subassembly comprising:

an insulating switch base;

stationary switch contacts mounted in said base and including terminals extending to the exterior thereof for connection to a circuit;

movable contact means within said base for bridging said stationary switch contacts; and lamp contacts mounted in said base and comprising contact fingers biased against opposite surfaces of said PC board and terminals extending to the exterior for connection to a circuit;

and means for snap-in mounting said actuator subassembly within the base of said housing subassembly for pivotal movement so that said actuator acts on said movable contact means to close and open said movable contact means with respect to said stationary switch contacts when said operating member is manipulated, and so that said PC board simultaneously connects said indicator lamp to said lamp contacts in a predetermined position of said operating member.

2. The pivoted-actuator switch with PC board switched light indicator claimed in claim 1, wherein:

said operating member comprises channel means therewithin accommodating the upper portion of said PC board to retain it securely in its place.

3. The pivoted-actuator switch with PC board switched light indicator claimed in claim 1, wherein:

said PC board comprises shoulder means engaged by said switch contact actuator when the latter is snap-in mounted to said operating member to clamp said PC board securely therebetween.

4. The pivoted-actuator switch with PC board switched light indicator claimed in claim 1, wherein:

each said lamp contact comprises a terminal leg portion extending through and secured in a hole through the bottom of said base and a pair of resilient fingers having convex portions at their upper end contacting one surface of said PC board.

5. The pivoted-actuator switch with PC board switched light indicator claimed in claim 1, wherein:

said operating member is a toggle lever;

and said indicator lamp is mounted in said hole in the upper end thereof flush with the upper end surface of said toggle lever and above said PC board.

6. The pivoted-actuator switch with PC board switched light indicator claimed in claim 1, wherein:

said operating member is a rocker button;

and said indicator lamp is mounted in said hole at one side thereof flush with the upper surface of said rocker button beside the upper portion of said PC board.

7. The pivoted-actuator switch with PC board switched light indicator claimed in claim 1, wherein:

said stationary switch contacts and said movable contact means provide a two-position OFF-ON mode of switch operation;

and said printed circuits on opposite sides of said PC board are arranged to close the indicator lamp circuit in one of the positions of said switch.

8. The pivoted-actuator switch with PC board switched light indicator claimed in claim 1, wherein:

said stationary switch contact-terminals and said movable contact means provide a three-position ON-OFF-ON mode of switch operation;

and said printed circuits on opposite sides of said PC board are arranged to afford closure of the indicator lamp circuit only in the two ON positions of the switch.

9. A pivoted-actuator switch with PC board switched light indicator comprising two subassemblies including:

an actuator subassembly comprising:

an operating member having a hole extending through an upper surface thereof to a bottom side of said operating member;

an indicator lamp mounted in said hole so as to be visible at the upper surface of said operating member and having electric leads extending through said hole to the bottom side of said operating member;

a PC board positioned partly within said operating member for direct movement therewith and having printed circuits on opposite surfaces thereof connected to said leads;

and a switch contact actuator snap-in mounted to said operating member and having an aperture through which said PC board partly extends;

and a housing subassembly comprising:

an insulating switch base;

stationary switch contacts mounted in said base and including terminals extending to the exterior thereof for connection to a circuit;

movable contact means within said base for bridging said stationary switch contacts; and lamp contacts mounted in said base and comprising contact fingers biased against opposite surfaces of said PC board and terminals extending to the exterior for connection to a circuit;

and means for snap-in mounting said actuator subassembly within the base of said housing subassembly for pivotal movement so that said actuator acts on said movable contact means to close and open said movable contact means with respect to said stationary switch contacts when said operating member is manipulated, and so that said PC board simultaneously connects said indicator lamp to said lamp contacts in a predetermined position of said operating member;

said operating member is a toggle lever having two pairs of walls therewithin providing slots between the walls of said pairs of walls for receiving the opposite upper portions of said PC board;

and said aperture in said switch contact actuator is in the plane of said slots to retain said PC board in a vertical, centered relationship relative to said contact fingers.

* * * * *